US006755683B2

(12) United States Patent
Roberts et al.

(10) Patent No.: US 6,755,683 B2
(45) Date of Patent: Jun. 29, 2004

(54) PRINTED CIRCUIT CONNECTOR

(75) Inventors: Joseph A. Roberts, Hudson, NH (US); Jonathan F. Roberts, Litchfield, NH (US)

(73) Assignee: Miraco, Inc., Manchester, NH (US)

( * ) Notice: Subject to any disclaimer, the term of this patent is extended or adjusted under 35 U.S.C. 154(b) by 0 days.

(21) Appl. No.: 10/203,417

(22) PCT Filed: Feb. 8, 2001

(86) PCT No.: PCT/US01/04295

§ 371 (c)(1),
(2), (4) Date: Aug. 8, 2002

(87) PCT Pub. No.: WO01/61792

PCT Pub. Date: Aug. 23, 2001

(65) Prior Publication Data

US 2003/0027449 A1 Feb. 6, 2003

Related U.S. Application Data

(60) Provisional application No. 60/182,615, filed on Feb. 15, 2000.

(51) Int. Cl.[7] ..... H01R 23/66
(52) U.S. Cl. ..... 439/496

(58) Field of Search ..... 439/495, 496

(56) References Cited

U.S. PATENT DOCUMENTS 4,740,867 A 4/1988 Roberts
5,009,607 A * 4/1991 Gordon et al. ..... 439/67
5,350,319 A 9/1994 Roberts

FOREIGN PATENT DOCUMENTS

DE 2513635 * 10/1975

* cited by examiner

*Primary Examiner*—Neil Abrams
(74) *Attorney, Agent, or Firm*—Davis & Bujold, PLLC

(57) ABSTRACT

A connector for connecting conductors of a flexible circuit to conductive elements comprising a one-piece, plastic housing defining at least one opening for access to the connector for contact with conductors of a flexible circuit located in the connector and biased for conductive contact with electrical contacts by a contact biasing spring, the flexible circuit and spring being mounted to a sled located in the housing and the sled having detents to engage respective openings in the housing to support the sled, and an associated method is also provided.

14 Claims, 3 Drawing Sheets

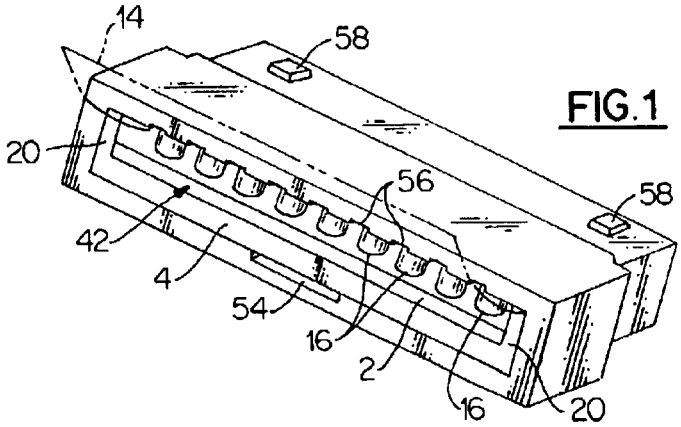
FIG.1
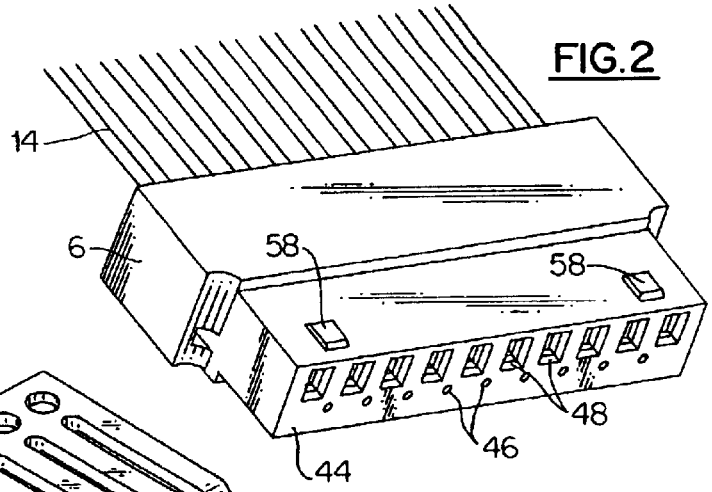
FIG.2
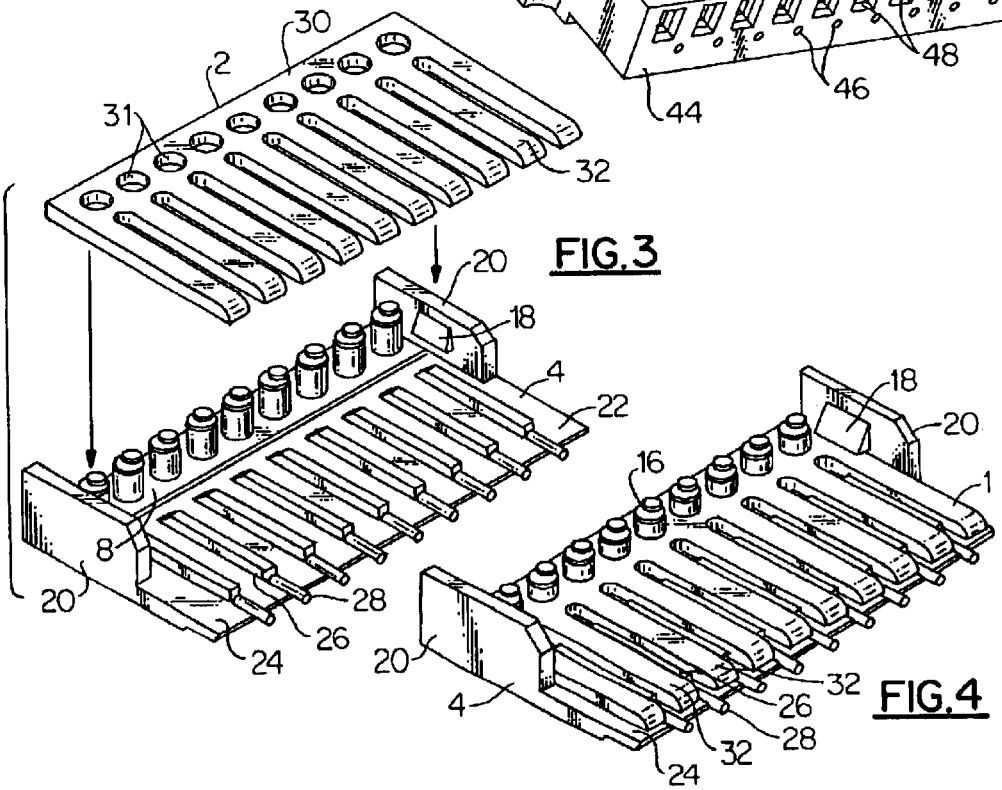
FIG.3
FIG.4

PRINTED CIRCUIT CONNECTOR

This application claims the benefit of Provisional Application No. 60/182,615, filed Feb. 15, 2000.

This application relates to a separate connector system for releasably connecting conductive paths of a flexible circuit to closely packed conductive pads or posts.

BACKGROUND OF THE INVENTION

In electrical systems, flexible printed circuits are employed as electrical jumpers or cable for interconnecting rows of terminal pins or pads of printed circuit boards. A connector, mounted to one or both ends of the jumper, has typically been formed with a set of electrical receptacles or sockets which are designed to receive the terminal posts or contact the pads on the printed circuit board.

In today's electronics market, manufacturers are placing emphasis on increasing their product's reliably and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple high density interconnections to other modules.

Connector manufacturers have not kept pace with today's market needs. Simply stated, conventional connector technology cannot accommodate today's high-density requirements. Most existing connectors consist of individual stamped contacts assembled into a molded plastic housing. The physical size required to manufacture an acceptable spring contact eliminates this technology in high-density circuits. For the last thirty years, electronic systems have been designed around conventional connector technology. Connector manufacturers have effectively led this market, and system designers gladly followed, because these connectors satisfied their needs. This cannot continue as significant events are combining to change the role of connectors forever, including a new generation of chips that are driving PC board manufacturers to produce boards with conductors having 0.015" wide contacts on 0.025" or less centers. These boards must be interconnected to other modules or to the outside world and will require a high-density connector and interconnect cable.

These key events have led to development of the high-density connector system of the present invention.

U.S. Pat. No. 4,740,867 discloses a connection system for connecting a flexible circuit having a row of printed contact areas to a PC board having a corresponding row of terminal posts employs a connector having a housing with a bottom wall and a pair of side walls at least one of which is movable with respect to the other. A row of post-receiving passages are present in the bottom wall which passages are arranged to receive the posts of the PC board. An edge margin of the flexible circuit is clamped between the housing side walls so that the contact areas thereon are aligned with the passages in the housing bottom wall and a set of springs positioned inside the housing flexes the circuit edge margin so that when the movable housing side wall is in its closed position, the row of contact areas overhang the passages in the housing bottom wall. Consequently, when the connector housing is impaled on the printed PC board posts, the posts project into the housing and are resiliently engaged by corresponding ones of the flexible circuit conductive areas.

While providing a connector arrangement for closely spaced posts on printed circuit boards, the connector of U.S. Pat. No. 4,740,867 has significant drawbacks involving the use of expensive fixtures to facilitate assembly of the connector and, even then, involves difficult assembly techniques. Further this connector has a component retaining shell or housing, which is prone to failure due to pressures applied when the posts are inserted into the connector. Additional discussion of the limitations of the connector of U.S. Pat. No. 4,740,867 will be found in the inventor's notes forming a part of this document.

Subsequent to the development of the connector disclosed in U.S. Pat. No. 4,740,867, one of the inventors of the present application developed, and patented in U.S. Pat. No. 5,350,319, an edge connector for connecting flexible circuit conductors to contact pads of a PC board edge connector having a snap together housing of modular design having resiliently biased flexible circuits for contacting the pads, an alignment arrangement for alignment of the conductors and pads, protection for the free end regions of the flexible circuits and strain relief features, the connector being usable with conductors spaced 0.012" or less apart, and being easily assembled and disassembled.

The connector of U.S. Pat. No. 5,350,319 consists of a multi-part housing comprising two modules in mirror image disposed about two inner modules also in mirror image housing contact enhancing springs and contacts of a flexible circuit for engagement with contacts on both sides of an edge connector of printed circuit board, all of which are connected together by a housing 6 which is snapped over the outer modules. Although this arrangement improves ease of assembly, relative to U.S. Pat. No. 4,740,867 and also, permits disassembly of the connector, if and when needed, the structure is still complex and assembly is still difficult and expensive.

SUMMARY OF THE INVENTION

It is an object of the present invention to provide a separable connector system for reliably and releasably connecting the conductive circuit paths of a flexible circuit to closely packed (high density) conductive pads or posts of a PC board in a way that does not require solder, crimping or welding operations in order to interconnect the two circuits, the connector system providing accurate registration to ensure reliable desired connection.

A further object is to provide a connector system which can be formed as an inexpensive structure, is relatively easy and inexpensive to make in quantity and can be mounted to the end of a flexible circuit without requiring any tool and which can be readily connected to and aligned with contact pads on the face of a printed circuit board.

The present invention comprises a one-piece molded housing, open at one end to receive connector components, and defining, at an opposed end, at least one aperture for receiving a post or edge connector of a printed circuit board for connection to conductive contact areas of a flexible circuit extending into the connector. A flat contact biasing spring is supported, by holes, on posts of the connector, which are formed on a sled designed to be inserted into the open end of the one-piece housing during assembly so that the posts engage and are located by the one-piece housing with a resilient detents engaging an opening in the housing to locate the sled in place after assembly. The flexible circuit extends over the posts on which the spring is mounted and engages strain relief posts on the sled adjacent the open end of the housing.

More specifically, the invention provides a connector for connecting conductors of a flexible circuit to conductive elements comprising a plastic shell defining at least one opening for access of the conductive elements into the connecter for contact with the conductors, the conductors being located in the connector and biased for the conductive contact with the conductive elements by a flat contact biasing spring, the flexible circuit and spring being mounted to a sled, the sled being supported in the housing by pins and a detent on the sled engaging a detent receiving opening in the housing.

Preferably: the spring comprises a plurality of parallel spring tines supported by a cross-member interconnecting one end of the tines, the cross-member defining openings engaging posts projecting from a spring support and orientation controlling pad of the sled; the available spring tine deflection is determined by a spring engaging surface of the pad relative to the sled and the sled has spacer plates with detents to firmly hold the cross-member against the pad; the pins comprise a plurality of mounting pins engaging openings in an end portion of the flexible circuit between the conductors thereof, the flexible circuit also having openings engaging the posts to provide strain relief for the flexible circuit whereby the flexible circuit is supported on the sled with the spring therebetween and the conductors exposed for contact with the conductive elements; the shell has openings, adjacent the at least one opening, to receive the mounting pins to align the sled and hold the end of the flexible circuit captive on the mounting pins; the shell has slots to receive ends of the posts to hold the flexible circuit captive on the posts; and the shell has a substantially rectangular interior cavity and the spacer plates are sized to engage wall of the cavity to locate the sled, spring and flexible circuit in the shell in coordination with the detent on the sled engaging the detent receiving opening.

Also according to the invention a method of producing a connector for connection to conductive elements comprises: a) providing a one-piece, plastic housing having opposed first and second ends, the first end incorporating openings for receiving the conductive elements and the second end being open for the insertion of interior features of the connector. b) providing a sled capable of insertion in the second end of the housing and including alignment and retention features for aligning and retaining the sled in the housing; c) mounting a conductor carrying flexible circuit to retaining features and strain relief features formed on the sled; d) mounting a flexible circuit biasing flat spring on the retaining features of the sled in a location to bias contacts of the printed flexible circuit into conductive contact with the conductive printed circuit features when inserted through the opening in the first end of the housing, and e) inserting the sled with the flexible circuit and spring mounted thereon through the open second end of the housing to engage the alignment and retaining feature of the sled with the housing to locate the sled within the housing to provide an assembled connector complete with the interior features thereon.

BRIEF DESCRIPTION OF THE DRAWINGS

The invention will now be described, by way of example, with reference to the accompanying drawings, in which:

FIG. 1 is a perspective view of a connector according to one embodiment of the invention shown from a flexible circuit receiving end thereof;

FIG. 2 is a perspective view opposite that of FIG. 1

FIG. 3 is a perspective exploded view of a spring and sled of the connector of FIG. 1

FIG. 4 is a view of the spring and sled shown in FIG. 3, when assembled;

DESCRIPTION OF THE PREFERRED EMBODIMENTS

Figure 5:
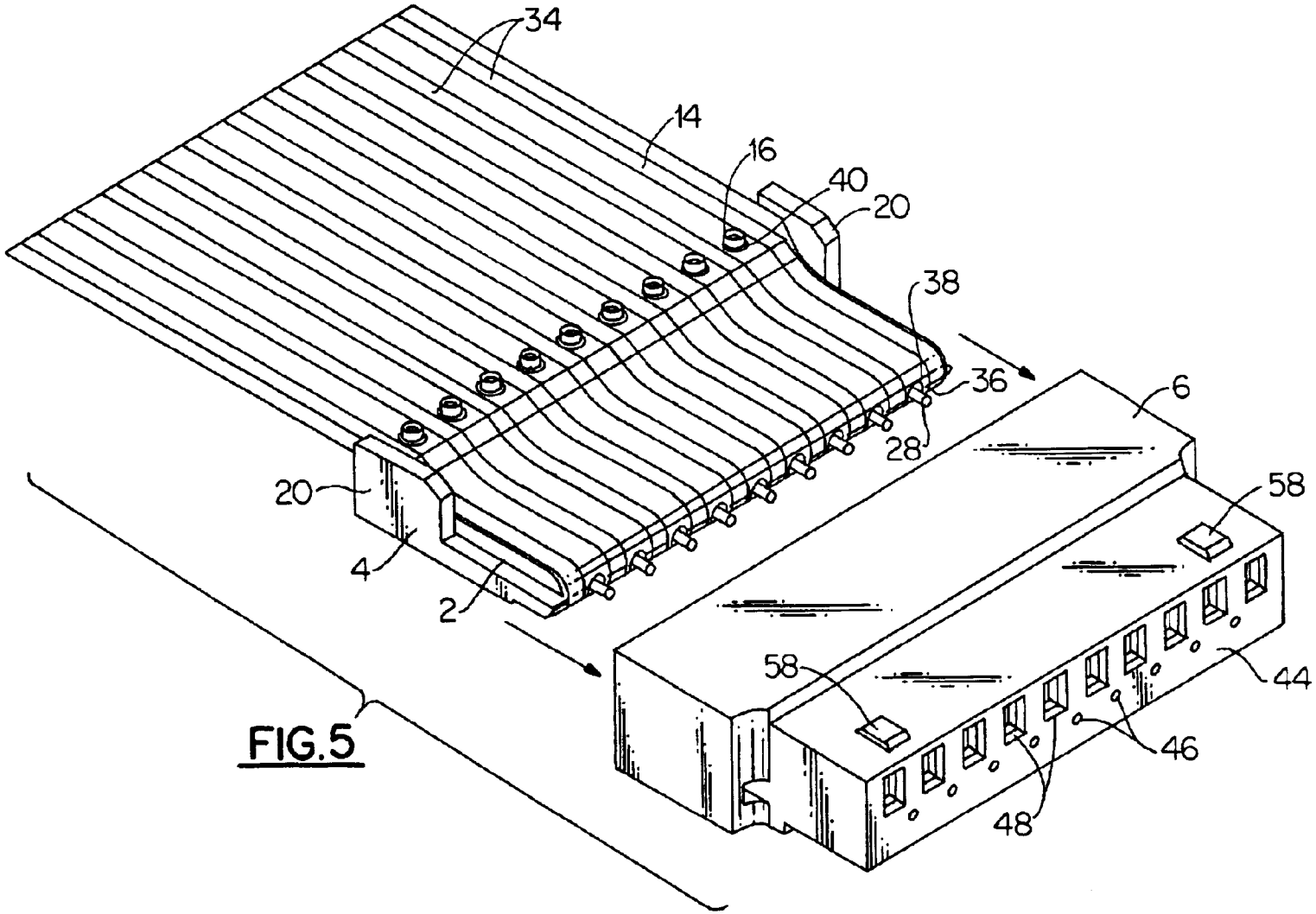
FIG. 5 is the assembly of FIG. 4 with attached flexible circuit ready for insertion into a connector housing shell.

FIGS. 1–6 disclose an embodiment having a flat spring 2 that contains and evenly disperses its compressed force across the body of a spring support sled 4. This eliminates the need to have accurately positioned spring retaining pins built into the connector support shell and allows for movement of the spring 2 in the shell 6 as it deflects. By eliminating the springs need to slide across the connectors base we have eliminated the expense associated with accurately controlling the smoothness of the connectors bases. In prior connectors applications the springs ability to expand and contract required that the connectors internal surface finish to be free of all nodules and ridges which could interfere with the spring's movements.

The contact engagement angle, depth of deflection and applied force of the spring 2 is, in part, controlled by the size and angle of its support pad 8 which is part of the sled 4.

The spring 2 is designed to easily compress as a mating pin 10, of a header 12, is inserted and to apply sufficient force against the flexible circuit 14 which extends into and is captively supported by the sled 4 in the shell 6 as to cause a light "wiping" action as a high pressure connection is achieved upon full insertion of the pin.

The flat spring 2 is free from manufacturing tolerances associated with bending the spring into a desired non-flat shape and subsequently heat treating it to attain the proper spring temper.

The flat spring 2 has contact engagement angle, depth of deflection and applied force, in part, controlled by the angle of the pad 8 upon which is located and aligned by posts 16 projecting from the pad 8 and located and held captive by detents 18 (one only being shown) facing one another one or each of guide plates 20 upstanding on opposite sides of the sled 4. The detents 18 are spaced from the pad 8 so as to firmly engage the side edges of the spring 2 to firmly urge the spring 2 against the pad 8.

Conventional contact and/or support springs control their engagement angle, applied force and depth of deflection by being formed into a desired configuration. Unfortunately, every bend introduces a new tolerance and all tolerances must be added up to determine the contacts required range of motion. A typical contact may require three bends at about ±0.002" per bend. This would require a forgiveness tolerance of 0.006". When backing a formed spring, it must also be capable of accommodating its manufacturing tolerances which is typically ±0.03" (thickness). When all these tolerances are added to the springs requires activation range of 0.006" we now need a spring that has a 0.015" "active" range. This is both mechanically and economically impractical in a connector with a thickness of less than 0.100".

Flat spring technology offers:

Tolerance relief, flat springs have no forming tolerances. This significantly increases the springs positional accuracy and insures the correct contact force is applied.

Increased deflection range and contact force. Beam length, width, thickness and material control all required operating parameters. By eliminating contact forming structural limitations are eliminated.

Low cost, eliminating complex forming reduces manufacturing and assembly costs, and allows us versatility of manufacturing. We are not limited to stamping because we have no forming. Our springs can be made by etching, EDM, lasering, simple punches, etc.

Versatility, the contacts force and deflection range is easily modified by adjusting the angle of the spring retaining slot in the molded base this versatility also gives us a wider choice of spring material which is great for times like now where there is a beryllium copper (BeCu) shortage. We may have several molded bases, with a variety of applications.

Front loaded springs are easily built using a flat spring. The use of a flat spring allows us to move the point of contact force toward the front of the connector.

Support shim allows us to change the spring thickness within a common spring retaining slot.

Now to describe the components and interaction of the connector we turn first to FIGS. 3 and 4 which show spring 2 and sled 4 before assembly to form a subassembly for mounting a flexible circuit 14, which acts as a multi-conductor interconnect cable, before being inserted in the shell 6.

The sled 4 comprises a base 22 above the surface 24 of which is formed the pad 8 extending from one plate 20 to the other plate 20. The pad 8 in turn carries a plurality of equally spaced posts 16 in a row along the pad 8. Adjacent the free end of each post 16 the cross-section of the post is reduced and this reduced cross-section terminates the free end.

Aligned with the posts 16 projecting from the surface 24 are parallel guide bars 26 which terminate in flexible circuit supporting and sled alignment pins 28.

The flat spring 2 (made e.g. of beryllium copper) has a transverse portion 30 which supports a plurality of spring times 32 and defines a plurality of holes 31 each to engage a post 16 (FIG. 4) while at the same time opposite edges of the portion 30 are held captive between the detents 18 and pad 8. By this means the spring tines 32 are, when free of deflection, spaced above surface 24 and between the guide bars 26 with the pins 28 projecting beyond the base 22 and the tines 32.

Referring now to FIG. 5 the flexible circuit 14 has a plurality of conductors 34 in this case greater by one than the plurality of posts 16 and the like plurality of pins 28. The conductors extend lengthwise of the flexible circuit 14, which may be of any desired length. Adjacent the connector end 36 of the flexible circuit 14, a plurality of openings 38 are formed, between the conductors 34, one to engage each of the pins 28 to support the flexible circuit 14 thereon. A similar plurality of openings 40 also between the conductors 34 are disposed to engage the posts 16 to retain and provide strain relief of the flexible circuit 14 on the sled 4 for deflection with the tines 32. The remaining portion of the flexible circuit 14 projects from the rear 42 (FIG. 1) of the shell 6 to act as a multi-conductor cable.

The shell 6 is of generally rectangular form defining a generally rectangular opening 42 to receive and align the flexible circuit-spring-sled assembly (FIG. 5). To this end the front 44 of the shell has pin engaging openings 46 to closely receive pins 28 when the assembly is fully inserted into the shell 6 thereby to retain the flexible circuit 14 on the pins 28 with conductors 34 aligned with openings 48 spaced to receive mating pins 10 of the header 12.

The plates 20 on the sides of the sled 4 are of a height to engage the interior of the shell 6 to maintain the sled firmly against the base of that interior and are spaced part of prevent side to side motion of the sled 4 adjacent the rear of the shell 6. Additionally the underside of the sled 4 has a detent 50 which engages an opening 52 in the base of the shell 6 to firmly retain the flexible circuit-spring-sled assembly within the shell; assembly being facilitated by a groove 54 in the floor of the interior of the shell 6 whereby the material (plastic molding) of the shell 6 and sled 4 can flex sufficiently for insertion to occur.

The terminal portions of reduced diameter of posts 16 engage slots 56 in the upper interior surface of the shell 6 to hold the flexible circuit 14 captive on the posts 16.

Although not illustrated detents 58 provide a retaining means for appropriately designed headers.

Figure 6:
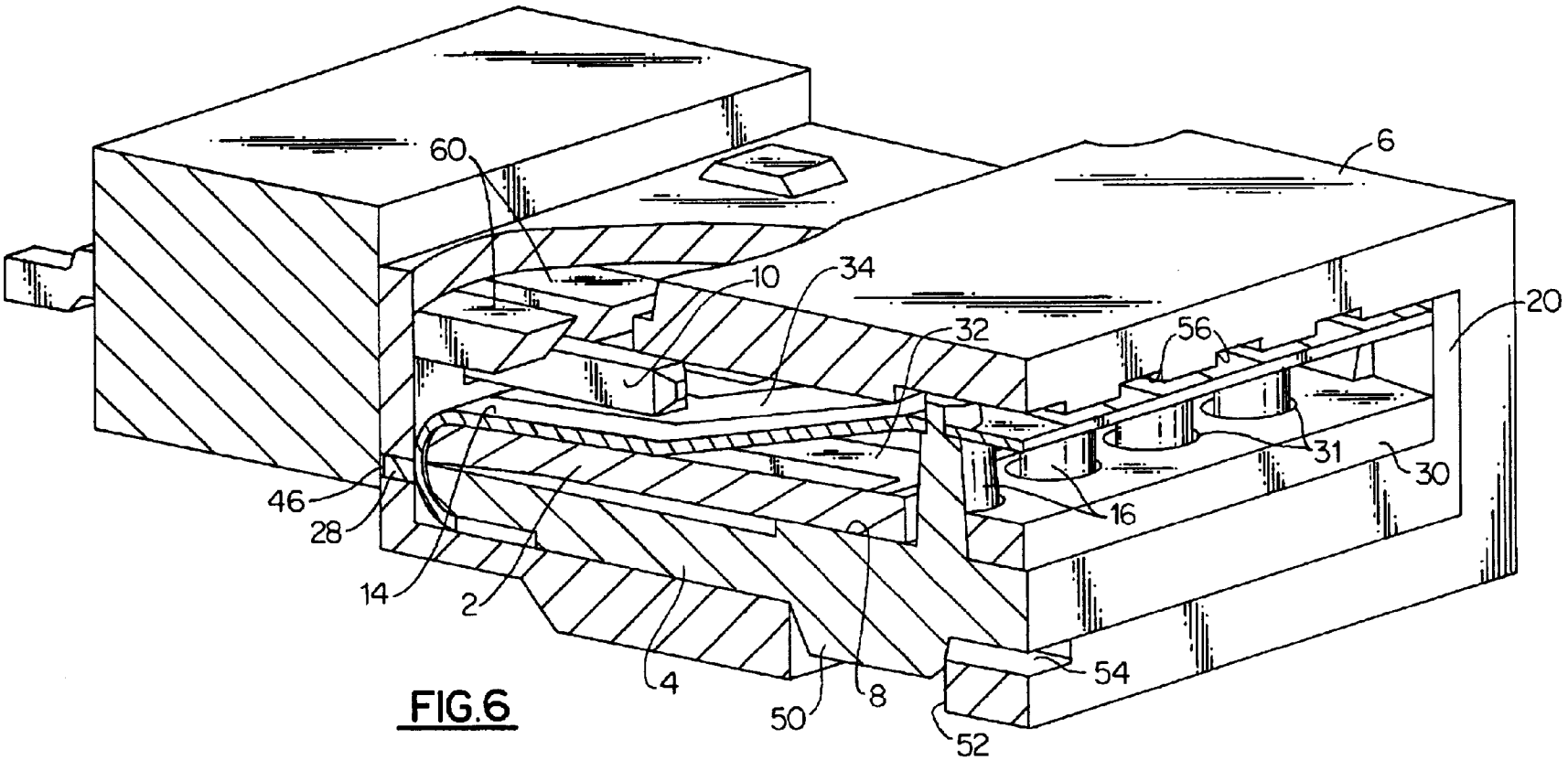
FIG. 6. Is a partially sectioned perspective view of the connector of FIG. 1 with a header attached.

Referring to FIG. 6, a series of parallel projections 60 extend from the interior front face of the shell 6 between mating pin openings 48 to act as alignment guides for mating pins 10 as they are inserted into the connector to firmly engage conductors 34 under the resilient deflection of the spring 2.

It will be appreciated that apart from the spring 2 and conductors 34 of the flexible 14 the components of the connector are all of a dielectric material e.g. polymer moldings.

| Reference Numbers | |
|---|---|
| 2 | spring |
| 4 | sled |
| 6 | shell |
| 8 | pad |
| 10 | mating pin |
| 12 | header |
| 14 | flexible circuit |
| 16 | spring and circuit posts |
| 18 | spring mounting detents |
| 20 | side plates |
| 22 | base of sled |
| 24 | surface of base |
| 26 | guide bars on base 22 |
| 28 | circuit and shell engaging pins |
| 30 | spring portion |
| 31 | holes in spring |
| 32 | tines |
| 34 | conductors of circuit |
| 36 | connector end of circuit |
| 38 | openings in circuit connector end |
| 40 | openings to engage posts 16 |
| 42 | rectangular opening to receive sled assembly |
| 44 | front of shell |
| 46 | openings for pins 28 |
| 50 | detent on sled |
| 52 | opening in shell for detent 50 |
| 54 | groove to receive detent 50 |
| 56 | slots in shell to receive posts 16 |
| 58 | detents for header |
| 60 | projections to guide mating pins 10 |

We claim:

1. A connector for connecting conductors of a flexible circuit to conductive elements comprising a plastic shell defining at least one opening for access of the conductive elements into the connector for contact with the conductors, the conductors being located in the connector and biased for the conductive contact with the conductive elements by a flat contact biasing spring, the flexible circuit and spring being mounted to a sled, the sled being aligned in the shell by pins and a detent on the sled engaging a detent receiving opening in the shell; and wherein the spring comprises a plurality of parallel spring tines supported by a cross-member interconnecting one end of the tines, the cross-member defining openings engaging posts projecting from a spring support and orientation controlling pad of the sled.

2. The connector of claim 1 wherein the available spring tine deflection is determined by a spring engaging surface of the pad relative to the sled and the sled has spacer plates with detents to firmly hold the cross-member against the pad.

3. The connector of claim 2 wherein the pins comprises a plurality of mounting pins engaging openings in an end portion of the flexible circuit between the conductors thereof, the flexible circuit also having openings engaging the posts to provide strain relief for the flexible circuit whereby the flexible circuit is supported on the sled with the spring therebetween and the conductors exposed for contact with the conductive elements.

4. The connector of claim 3 wherein the shell has openings, adjacent the at least one opening, to receive the mounting pins to align the sled and hold the end of the flexible circuit captive on the mounting pins.

5. The connector of claim 4 the shell has slots to receive ends of the posts to hold the flexible circuit captive on the posts.

6. The connector of claim 3 wherein the shell has a substantially rectangular interior cavity and the spacer plates are sized to engage wall of the cavity to locate the sled, spring and flexible circuit in the shell in coordination with the detent on the sled engaging the detent receiving opening.

7. A connector for connecting conductors of a flexible circuit to conductive elements comprising a plastic shell defining at least one opening for access of the conductive elements into the connector for contact with the conductors, the conductors being located in the connector and biased for the conductive contact with the conductive elements by a cantilevered flat contact biasing spring, the flexible circuit, and the cantilevered spring only along one longitudinal edge, being mounted to a sled, the sled being aligned in the shell by pins and a detent on the sled engaging a detent receiving opening in the shell.

8. The connector of claim 7 wherein the spring comprises a plurality of parallel spring tines supported by a cross-member interconnecting one end of the tines, the cross-member defining openings engaging posts projecting from a spring support and orientation controlling pad of the sled.

9. The connector of claim 8 wherein the available spring tine deflection is determined by a spring engaging surface of the pad relative to the sled and the sled has spacer plates with detents to firmly hold the cross-member against the pad.

10. The connector of claim 9 wherein the pins comprises a plurality of mounting pins engaging openings in an end portion of the flexible circuit between the conductors thereof, the flexible circuit also having openings engaging the posts to provide strain relief for the flexible circuit whereby the flexible circuit is supported on the sled with the spring therebetween and the conductors exposed for contact with the conductive elements.

11. The connector of claim 10 wherein the shell has openings, adjacent the at least one opening, to receive the mounting pine to align the sled and hold the end of the flexible circuit captive on the mounting pins.

12. The connector of claim 11 the shell has slots to receive ends of the posts to hold the flexible circuit captive on the posts.

13. The connector of claim 9 wherein the shell has a substantially rectangular interior cavity and the spacer plates are sized to engage wall of the cavity to locate the sled, spring and flexible circuit in the shell in coordination with the detent on the sled engaging the detent receiving opening.

14. A method of producing a connector for connection to conductive elements comprising:

a) providing a one-piece, plastic housing having opposed first and second ends, the first end incorporating openings for receiving the conductive elements and the second end being open for the insertion of interior features of the connector;

b) providing a sled capable of insertion in the second end of the housing and including alignment and retaining features for aligning and retaining the sled in the housing;

c) mounting a flexible circuit biasing flat spring on the retaining features of the sled in a location to bias contacts of a printed flexible circuit into conductive contact with the conductive elements when inserted through the opening in the first end of the housing;

d) mounting a conductor carrying the flexible circuit to the retaining features and strain relief features formed on the sled, and e) inserting the sled with the flexible circuit and spring mounted thereon through the open second end of the housing to engage the alignment and retaining feature of the sled with the housing to locate the sled within the housing to provide an assembled connector complete with the interior features thereon.

* * * * *